US006796244B2

(12) United States Patent
Loubser

(10) Patent No.: US 6,796,244 B2
(45) Date of Patent: Sep. 28, 2004

(54) OPENING AND CLOSING A CONTAINER

(75) Inventor: Petrus Hugo Loubser, Strand (ZA)

(73) Assignee: Denel (Proprietary) Limited, Gauteng Province (ZA)

( * ) Notice: Subject to any disclaimer, the term of this patent is extended or adjusted under 35 U.S.C. 154(b) by 0 days.

(21) Appl. No.: 10/406,434

(22) Filed: Apr. 3, 2003

(65) Prior Publication Data

US 2004/0107860 A1 Jun. 10, 2004

(30) Foreign Application Priority Data

Dec. 4, 2002 (ZA) ..... 2002-9842

(51) Int. Cl.[7] ..... F42B 12/36; F42B 30/08

(52) U.S. Cl. ..... 102/473; 102/517; 102/477; 102/357; 102/489

(58) Field of Search ..... 102/340, 342, 102/351, 357, 377, 378, 393, 481, 489, 517, 524, 473, 501, 503, 504, 505, 477

(56) References Cited

U.S. PATENT DOCUMENTS 4,109,577 A * 8/1978 Bjorkqvist et al. ..... 102/489
4,771,696 A * 9/1988 Smolnik ..... 102/489
5,183,962 A * 2/1993 Karius et al. ..... 102/489
5,735,114 A * 4/1998 Ellingsen ..... 102/481
2003/0205161 A1 * 11/2003 Roach ..... 102/481

FOREIGN PATENT DOCUMENTS

EP 395456 * 10/1990 ..... 102/489
FR 2705144 * 5/1993 ..... 102/489

* cited by examiner

*Primary Examiner*—Jack W. Keith
*Assistant Examiner*—James S. Bergin
(74) *Attorney, Agent, or Firm*—Senniger Powers

(57) ABSTRACT

A ballistic projectile (10) includes a body (12) defining a hollow, open-ended payload cavity (22) covered by means of a cover portion (26) fitting as a spigot into a socket (12.1) defined by the body (12). Peripheral seats in the form of grooves (32), (34) are provided in register in peripheral slide surfaces of respectively the cover portion (26) and the body (12) forming the spigot-socket combination. A peripheral, discontinuous shear ring (36) is received within the respective grooves (32), (34) to bridge the interface and thus to lock the cover portion to the body. Pressure selectively generated in the payload cavity shears the ring (36) to allow parting of the cover portion to expose the payload cavity.

7 Claims, 2 Drawing Sheets

OPENING AND CLOSING A CONTAINER

Figure 1:
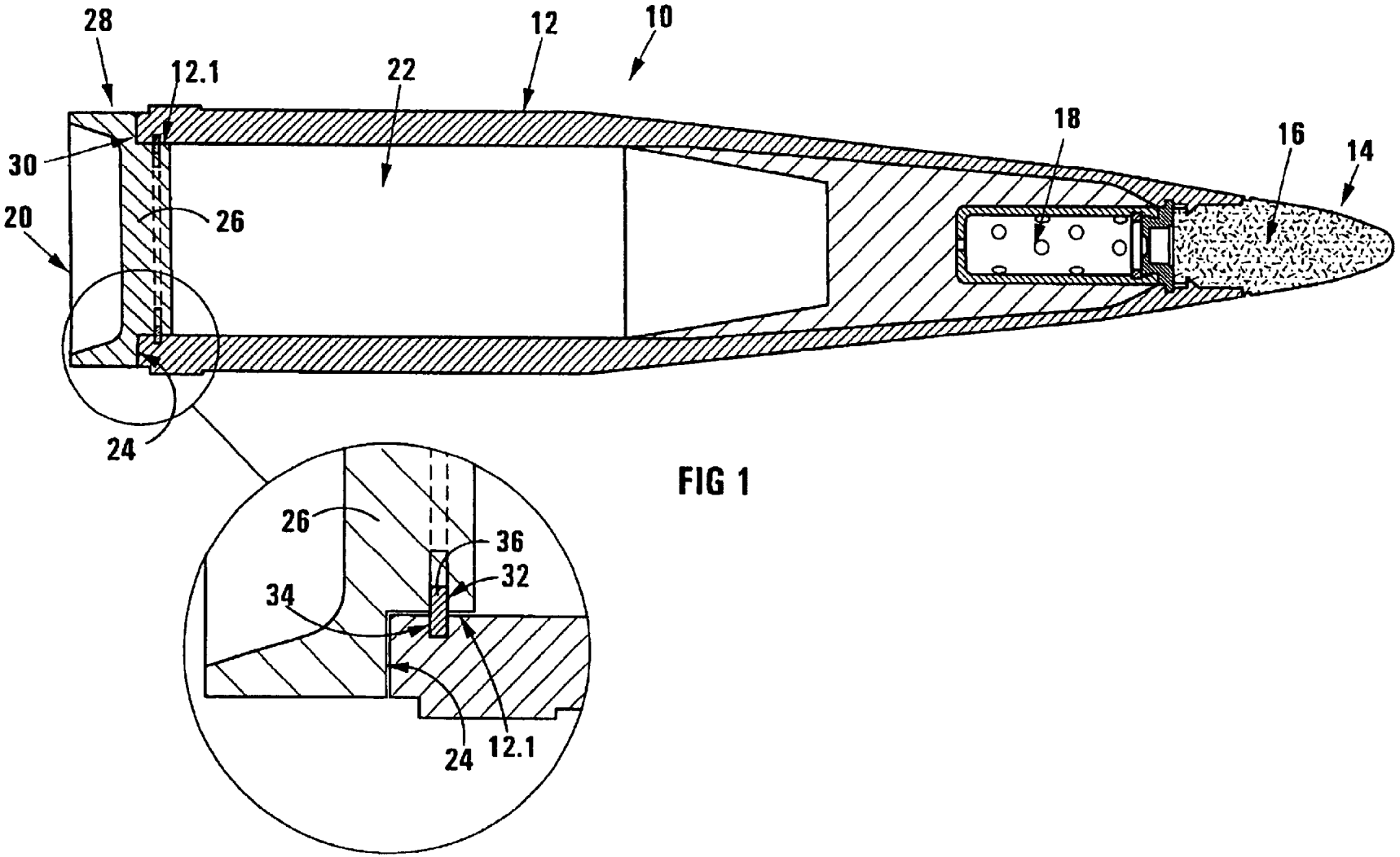

In accordance with a first aspect of this invention, there is provided a ballistic projectile including a body portion defining an internal cavity and having a surround around the cavity, the surround having a peripheral slide surface;

a cover portion having a peripheral slide surface complemental to said slide surface of the surround to render the body portion and the cover portion slidably closable onto each other to close the cavity;

complementally arranged peripheral seats in the respective slide surfaces, and a generally peripheral band seated in said seats such that the band bridges an interface between, and inter-secures, the body portion and cover portion.

The projectile may be round.

At least one of the surround, the cover portion and the peripheral band may be resilient to allow assembly. In practice, the peripheral band may be resilient. Thus, in a preferred embodiment, the slide surfaces may be round, and the band may be in the form of a resilient ring.

The resilient ring may be a split ring to allow a cross dimension thereof to be reduced/increased by compression/expansion, one of the seats being of sufficient capacity to accommodate the ring fully to allow the ring to be strained fully into said one seat to cause the ring to be flush with or shy of the corresponding slide surface.

Advantageously the seats and the band may be arranged to be concealed when assembled to render the projectile unopenable from externally and thus tamper proof.

Preferably, the band or the resilient ring may be a shear ring designed to fail at a predetermined shear force. Then, the ballistic projectile may include a pressure generator for generating internal pressure to a corresponding, predetermined pressure to shear the ring and to cause the cover portion to part from the body portion to expose the cavity. The ballistic projectile may be a base ejection projectile, the projectile including a pressure generator in the form of a propellant charge for generating internal pressure to a predetermined value to shear the ring and to cause the cover portion to part from the body portion to expose the cavity.

In accordance with a second aspect of the invention, there is provided a method of closing a ballistic projectile in accordance with the first aspect, the method including seating the band in one of the seats;

straining the band to be fully received within said one seat;

retaining the band fully in said one seat and closing the cover portion onto the body portion to register the seats;

causing the band to relax to move only partially out of said one of the seats and to move partially into the opposing other of the seats interlockingly to inter-secure the body portion and the cover portion.

The peripheral slide surface of the cover portion may fit inside the peripheral slide surface of the surround, the method including compressing the ring into the seat by means of a compression sleeve covering only a portion of the ring to allow the uncovered portion to be slid within the surround to hold the ring to allow the compression sleeve to be removed to allow the ring to be slid into register with the opposing seat. Once registered, the ring expands under its resilience to enter the opposing seat to bridge the interface.

In accordance with a third aspect of the invention, there is provided a method of opening a ballistic projectile in accordance with the first aspect, the method including generating pressure within the enclosed cavity to a sufficient degree to shear the band to cause the cover portion to part from the body portion under the internal pressure. Thus, generating internal pressure may be by initiating a propellant charge exposed to the cavity.

The method of opening the ballistic projectile may include the prior step of providing sealing between the respective slide surfaces to facilitate internal pressure generation.

Figure 2:
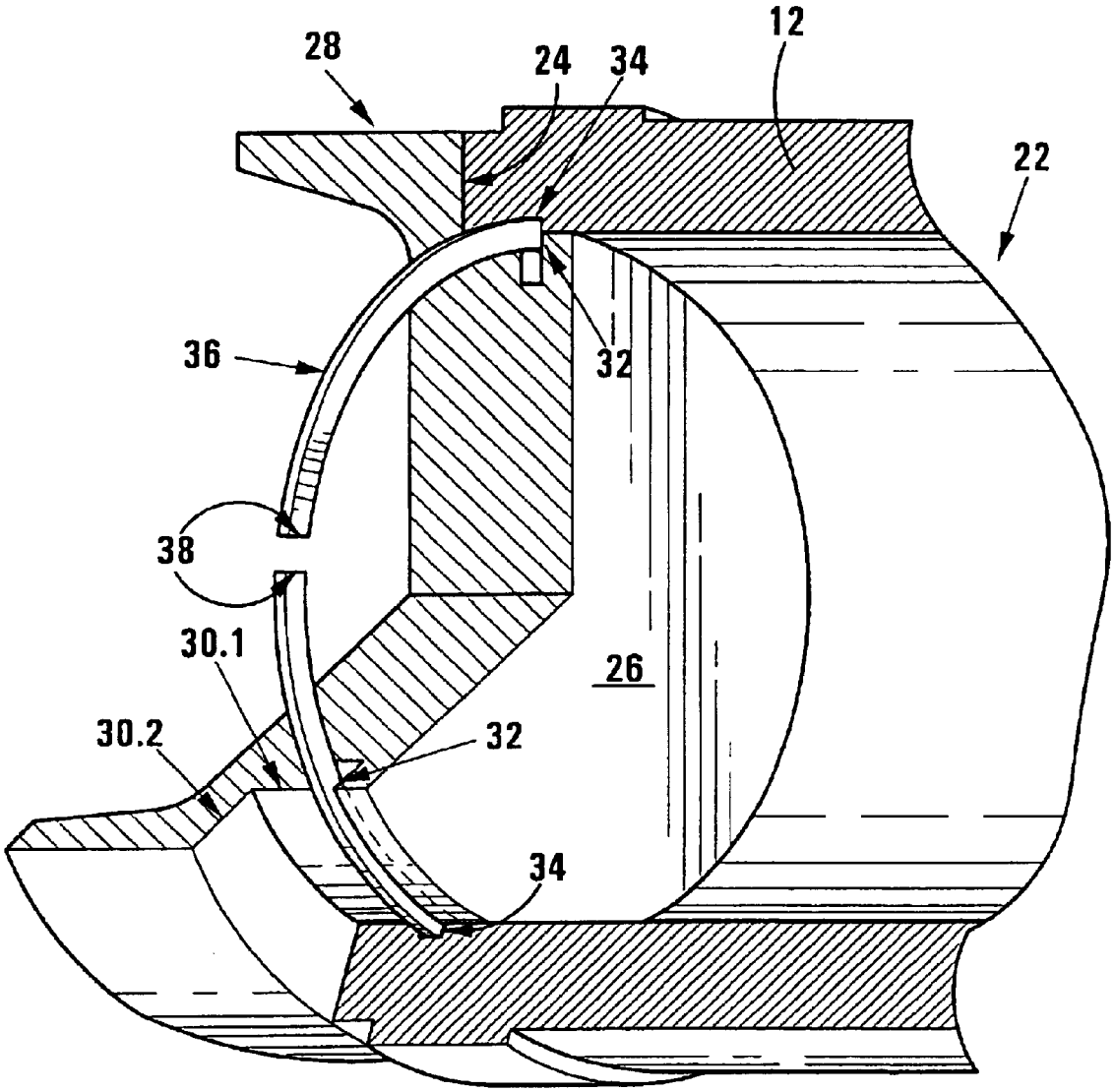

The invention is now described by way of example with reference to the accompanying diagrammatic drawings. In the drawings FIG. 1 shows, in axial section, a base ejection, ordnance gun projectile in accordance with the invention; and FIG. 2 shows, in three-dimensional, cut-away, fragmentary view to a larger scale, a base portion of the projectile of FIG. 1.

With reference to the drawings, a projectile of the kind used with ordnance guns is generally indicated by reference numeral 10. The projectile has a body 12 tapering toward a leading end 14 housing a fuse 16 immediately ahead of an ejection charge 18.

The body 12 extends in generally parallel fashion rearwardly toward a trailing end 20 where it terminates, boat tail-fashion, at a rear end 24. A cavity 22 for a payload is formed within the body 12.

The trailing end 20 is formed by a base 26 in the form of a disc having a peripheral rim 28 and a recess 30 along an axially inner, radially outer extremity of the rim. As can be seen in FIG. 2, the recess 30 forms a short cylindrical slide surface 30.1 and an annular abutting surface 30.2, generally at right angles to each other. The slide surface 30.1 forms an outer surface in accordance with this invention. The inner periphery of an end portion of the body 12 is in the form of a slide surface 12.1 which slides along and over the slide surface 30.1 with little clearance. In some embodiments, slight interference to ensure a slight frictional fit with the attended sealing may be preferred. The end wall 24 abuts the abutting surface 30.2.

In accordance with the invention, in the base 26, and more specifically in the slide surface 30.1, there is provided a peripheral seat in the form of a groove indicated by reference numeral 32. A corresponding seat in the form of a groove 34 is provided in the inner periphery of the body 12, more specifically the slide surface 12.1, such that the grooves 32, 34 will be mutually opposing and indexed when the end wall 24 abuts the abutting surface 30.2.

A resilient shear ring 36 which is in the form of a split ring as indicated by reference numeral 38, fits with little axial clearance within the groove 32. The ring 36 is resilient and the split 38 is sufficiently large to allow the ring 36 to be compressed such that it fits completely within the groove 32, i.e. such that an outer periphery of the ring 36 will be flush with or shy of the slide surface 30.1. When held in that configuration, the body 12 and more specifically the slide surface-12.1 formed by the end portion can be slid over the slide surface 30.1 and over the groove 32 with the ring 36 retained therein. When the end wall 24 abuts the abutting surface 30.2 and the grooves 32, 34 are indexed, the ring 36, under its resilience, expands to enter also the groove 34 and thus to bridge the interface between the slide surface 30.1 and the slide surface 12.1. Thus, the ring 36 interlocks the base 26 and the body 12 against relative axial sliding and thus causes locking of the base 26 onto the body 12.

It is important to appreciate that the ring 36 may, instead, be strained by expansion to be accommodated fully within the outer groove 34 to allow assembly and, when the grooves are indexed, it will retract under its resilience to move also into the inner grove 32.

The shearing function of the ring, which is most important in the context of this specification, is explained below.

In respect of sealing, it is important to appreciate that the degree of sealing required can generally be effected by means of a close or a very light interference fit which would add to the parting or separating force required to overcome friction, but which would be very much less than the force required if no shear ring is used and total reliance is placed on friction to effect securement of the components. Thus, the separation force required to overcome the interference fit, which is difficult to control and which varies widely, is a low percentage of the total separation force and thus adds correspondingly little to the overall uncertainty or variation in separation force.

Instead of a close or a light interference fit, sealing may be effected by means of a sealing substance, such as a lubricant or sealant, applied between the slide surfaces.

As a further option, the slide surfaces 30.1 and 12.1 may be complementally frusto-conical at a shallow angle to improve fit and sealing.

It is of significance that the end wall 24 abuts fully against the abutting surface 30.2 when the grooves are indexed. Thus, there is no or virtually no lost motion between the abutting surface 30.2 and the end wall 24, where there would be some lost motion between the ring 36 and sides of the grooves 32, 34. Thus, launching the projectile 10 from an ordnance gun which entails very high pressure at the trailing end 20, causes acceleration force to be transferred from the base 26 via the abutting surface 30.2 and the end wall 24 to the projectile body, and no force to be transmitted via the shear ring 36. Furthermore, because of the very high surface force transmitted from the abutting surface 30.2 to the end wall 24, spinning of the projectile through the barrel of the ordnance gun and the associated torque is also transmitted frictionally via those abutting surfaces. It is to be understood that, because of the very high pressure between those surfaces, friction forces are high i.e. substantially higher than what is required to transmit torque associated with spin. In the illustrated embodiment, spin is imparted to the body 12 via a propelling band proximate the end wall 24 and torque to spin only the base 26, which has relatively low inertia, is transmitted frictionally.

It is of great importance that the shear ring 36 is dormant during launching and normal flight of the projectile and that it is not stressed at all. Thus, the shear ring 36 and the characteristics thereof can be selected totally independently of requirements relating to launching and the flight of the projectile.

When the payload cavity 22 is to be exposed, the ejection charge 18 is initiated causing pressure to be generated within the payload cavity 22.

When the pressure within the cavity 22 corresponds to the failing shear force of the ring 36, the ring 36 shears and allows the pressure to separate the base 26 from the body 12 thus exposing the payload cavity 22.

It is important to appreciate that the shear force required to shear the ring 36 can be pre-selected over a wide range bearing in mind a number of design variables available, namely the material of the ring 36, the profile of the ring 36 and the thickness of the ring 36 along a shear line. The ring 36 may, for example be of metal, but it is expected to be mostly, advantageously, of a synthetic polymeric material selected to have appropriate shear characteristics.

It is of importance that the projectile, when closed in accordance with the invention, is tamper proof. It is to be appreciated that special tooling and some expertise are required easily to assemble a projectile, however, when such special tooling and expertise are available, assembling of the projectile is very cost efficient both in respect of time and the consumable namely the ring. This leads to another advantage in that, should the projectile be required to be opened prior to actual use, it can easily be done by shearing the shear ring 36 which is thus sacrificed. As mentioned above, such shear ring is inexpensive and the projectile can easily be reassembled by merely using a fresh shear ring. It is important that the projectile itself, including the grooves, is not damaged at all but that merely the shear ring is sacrificed.

Although the invention has been described with reference to a base ejection projectile for an ordnance gun, it will readily be appreciated that the invention is easily applicable to closing of any hollow body of a ballistic missile in tamper proof fashion and such that the body can easily be opened by means of a controlled internal pressure.

What is claimed is:

1. A ballistic projectile including a body portion defining an internal cavity and having a surround around the cavity, the surround having a longitudinal, round peripheral, slide surface;

a cover portion having a longitudinal, round peripheral, slide surface complemental to said slide surface of the surround to render the body portion and the cover portion longitudinally slidably closable onto each other to close the cavity and an annular abutting surface which is inseparably fixed to, is generally at right angles to, and stands proud of the slide surface of the cover portion;

complementally arranged peripheral seats in the respective slide surfaces, and a resilient generally peripheral ring which is a split ring to allow a cross dimension thereof to be reduced/increased by compression/expansion, one of the seats being of sufficient capacity to accommodate the ring fully to allow the ring to be strained fully into said one seat to cause the ring to be flush with or shy of the corresponding slide surface to allow the other of the slide surfaces to be slid past said one seat accommodating the ring fully, to index the seat to allow the ring to relax to enter said other seat such that the ring bridges an interface between, and intersecures, the body portion and the cover portion, the annular abutting surface covering said interface and rendering said peripheral ring concealed and rendering the projectile unopenable from externally and thus tamperproof.

2. A ballistic projectile as claimed in claim 1 in which the ring is a shear ring designed to fail at a predetermined shear force.

3. A ballistic projectile as claimed in claim 2 which includes a pressure generator for generating internal pressure to a corresponding, predetermined pressure to shear the ring and to cause the cover portion to part from the body portion to expose the cavity.

4. A ballistic projectile as claimed in claim 3 which is a base ejection, projectile, the projectile including a pressure generator in the form of a propellant charge for generating internal pressure to a predetermined value to shear the ring and to cause the cover portion to part from the body portion to expose the cavity.

5. A method of closing a ballistic projectile as claimed in claim 1, the method including seating the ring in one of the seats;

straining the ring to be fully received within one said seat;

retaining the ring fully in said one seat and closing the cover portion onto the body portion to register the seats;

causing the ring to relax to move only partially out of said one of the seats and to move partially into the opposing other of the seats interlockingly to inter-secure the body portion and the cover portion.

6. A method as claimed in claim 5, in which the ring is seated and strained to be fully received and retained in the seat which is in a radially inner of the slide surfaces.

7. A method as claimed in claim 6, in which said radially inner of the slide surfaces, is in the cover portion.

* * * * *